United States Patent [19]

Kleinerman

[11] 4,330,123

[45] May 18, 1982

[54] DEVICES AND METHODS FOR IMPROVING BOWLING SKILLS

[76] Inventor: Ben Kleinerman, 1760 Stewart Ave., New Hyde Park, N.Y. 11040

[21] Appl. No.: 192,537

[22] Filed: Sep. 30, 1980

[51] Int. Cl.[3] ..... A63B 71/06

[52] U.S. Cl. ..... 273/54 B

[58] Field of Search ..... 273/54 B, 183 B, 1 E, 273/16 C, 186 R, 183 R, 186 C, 186 A, 183 D, 193 R, 194 R; 434/247, 249, 252, 258

[56] References Cited

U.S. PATENT DOCUMENTS

| | | | |
|---|---|---|---|
| 2,064,603 | 12/1936 | Harrison . | |
| 2,191,683 | 2/1940 | Roberts . | |
| 2,834,597 | 5/1958 | Ylinen | 273/1 E |
| 2,994,533 | 8/1961 | Pupilla . | |
| 3,206,600 | 9/1965 | Butan . | |
| 3,301,559 | 1/1967 | Jolley . | |
| 3,350,100 | 10/1967 | Carmines . | |
| 3,362,023 | 1/1968 | McMahon | 273/183 B |
| 3,383,772 | 5/1968 | Gardner et al. . | |
| 3,649,013 | 3/1972 | Foster . | |
| 3,717,857 | 2/1973 | Evans . | |
| 3,788,647 | 1/1974 | Evans | 273/186 A |
| 4,059,267 | 11/1977 | Noble . | |

OTHER PUBLICATIONS

Howard M. Berlin, "*555 Timer Applications Source Book with Experiments*", p. 108, Figure 9-10.

*Primary Examiner*—Vance Y. Hum
*Assistant Examiner*—Leo P. Picard
*Attorney, Agent, or Firm*—Brooks, Haidt, Haffner & Delahunty

[57] ABSTRACT

Devices for assisting persons in developing and/or improving manual skills such as bowling, which devices comprise apparatus for attaching the device to a user's arm; a first sensor which makes or breaks an electrical circuit; a second sensor which makes or breaks an electrical circuit; an electrical power source; and an annunciator, wherein the first sensor makes a circuit when a first condition is sensed and the second sensor makes a circuit when a selected attitude is sensed, the circuit being made by the second sensor only after the first sensor makes the circuit, and the circuit activating the annunciator, together with methods for teaching proper follow-through using such devices.

12 Claims, 6 Drawing Figures

FIG. 4
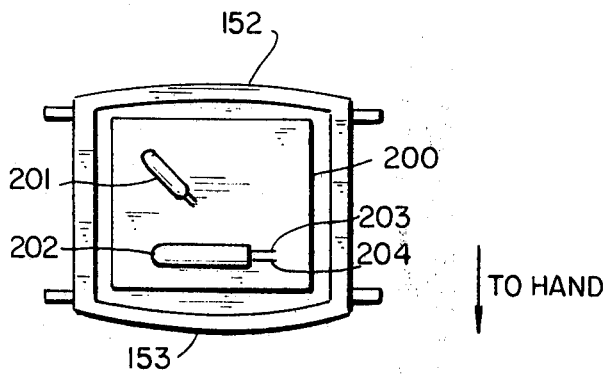
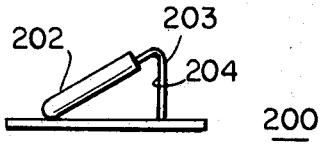
FIG. 5
FIG. 6
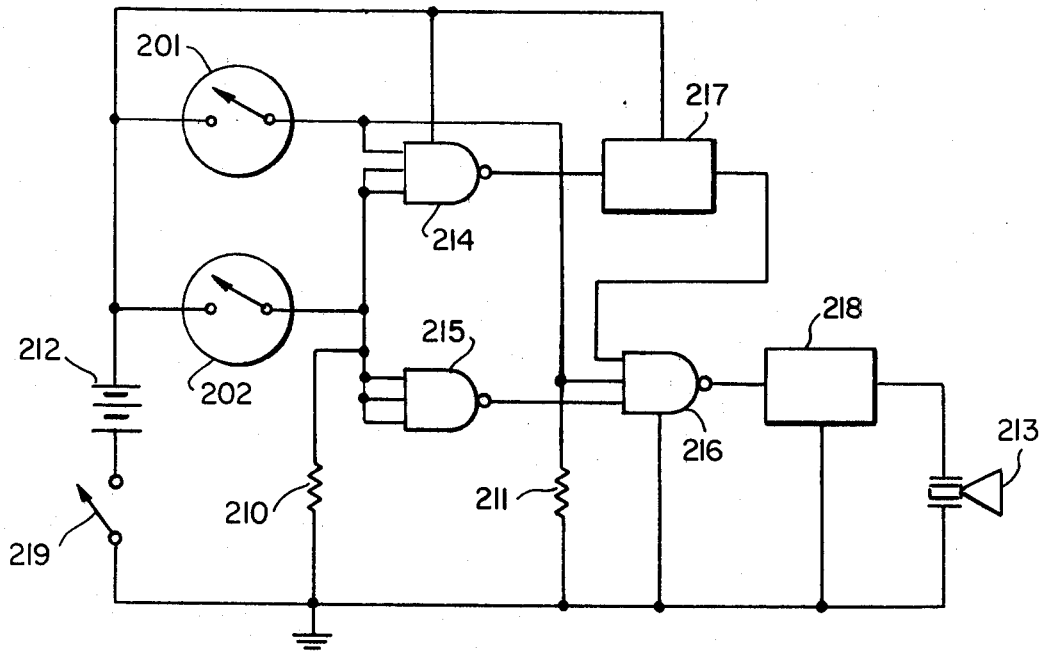

DEVICES AND METHODS FOR IMPROVING BOWLING SKILLS

BACKGROUND OF THE INVENTION

The present invention relates to devices and methods to assist in developing desirable behavior patterns, and more specifically, it relates to devices and methods for assisting persons in developing and/or improving manual skills or behavior patterns.

A wide variety of devices and systems have been developed to assist persons in altering their behavior patterns, such as cessation of a smoking habit or development of skills required for performing various athletic activities. One of the outstanding uses for the present devices is as aids in developing the correct coordination and dexterity in delivering a bowling ball.

Jolley, U.S. Pat. No. 3,301,559 shows a wrist-mountable device with a travelling metal ball which can traverse one of three channels to indicate the type of throw delivered by a bowler. The condition attained by the ball is of course transitory and must be noted by the bowler without substantial arm motion. Butan, U.S. Pat. No. 3,206,600, relates to a "plumb indicator" for bowlers and can contain a transistory buzzer unit to provide an audible signal when the indicator is plumb. Gardner et al, U.S. Pat. No. 3,383,772, shows a spirit level device attached to the wrist for purposes of indicating rotation of the forearm.

Harrison, U.S. Pat. No. 2,064,603, shows a clicker device to indicate bending of the wrist during a golf stroke. Pupilla, U.S. Pat. No. 2,994,533, shows a visual sighting device for bowlers, and Foster, U.S. Pat. No. 3,649,013, shows a spoonlike piece attached to a flexible cord. Roberts, U.S. Pat. No. 2,191,683, and Carmines, U.S. Pat. No. 3,350,100, show golfers' training devices, the former utilizing a sphere travelling in a channel to cause an audible signal. Evans, U.S. Pat. No. 3,717,857, uses an r-f coupled accelerometer to judge the correctness of a golf stroke. Noble, U.S. Pat. No. 4,059,267, shows a bowler's follow-through indicator utilizing a pendulum bar attached to the bowler's wrist.

There are a number of other devices exemplified by U.S. Pat. Nos. 2,585,075; 2,871,573; 3,413,000; 3,467,379; 3,606,343; 3,808,707; 4,059,267, and 4,193,065, which show various signalling means for devices intended to improve the athletic performance.

These prior art devices all have certain limitations. A few are extremely complex and would not be suitable for use during actual activity but would have to be set up in a special training area. Others utilize some transitory mechanical phenomenon which may require considerable care in practice, if a usable indication is to be obtained. Further, in providing such training devices, it is useful to have proper performance indicated in a readily usable device which will not interfere with the user's activities, is positive in indication, and will not give false signals or require elaborate resetting means.

THE INVENTION

The present invention provides devices which are useful in assisting an individual in developing manual skills, as for sporting activities. The devices of the present invention can, with no modification or with minor modification apparent to those skilled in the art after familiarizing themselves with this disclosure, be utilized to assist an individual in modifying a behavior pattern, as by sensing the arm motion associated with moving a cigarette to the lips or moving food to the lips. Thus, the devices can be used to assist those who wish to stop or reduce smoking or those who wish to reduce their caloric intake. The present invention will be described chiefly in terms of a bowler's training aid.

Briefly, the present device to assist in the development or improvement of manual skills comprises means for attaching the device to a user's arm in a manner such that a desired orientation of the device is obtained on the arm; a first sensing means which can make or break an electrical circuit; a second sensing means capable of making or breaking an electrical circuit; an electrical power source; and annunciator means. The first sensing means is responsive to a first condition of the user's arm and closes the electrical circuit upon sensing the condition. The second sensing means closes to make an electrical circuit when a predetermined attitude is obtained. After the first sensing means has formed a close electrical circuit and the second sensing means has attained the predetermined attitude (and thereby closed a circuit), the resulting completion of the electrical circuit by the second sensing means causes the annunciator to provide an appropriate signal to the user. In use as a bowler's training aid, the annunciator provides an aural and/or visual signal to the bowler when the correct follow-through has been completed by the bowler's having brought his arm through the release point for the ball and up to a substantially vertical position. Thus, the device of this invention is also used in a method for training bowlers, which method comprises affixing the device to a bowler's arm and the bowler than swinging his arm back on the backswing, bringing the ball forward, releasing the ball, and following through until his arm attains a substantially vertical position, whereupon the annunciator sounds to indicate correct follow-through. Insufficient follow-through will not activate the second sensing means, and there will be no signal under those circumstances.

The invention will be more particularly described by reference to the accompanying drawings, wherein FIG. 1 is a view of a device ready to be secured to a user's wrist;

FIG. 4 is a plan view of another embodiment of the device;

FIG. 5 is an elevation of a portion of FIG. 4; and

FIG. 6 is a circuit diagram of the device depicted in FIGS. 4 and 5.

Figure 1:
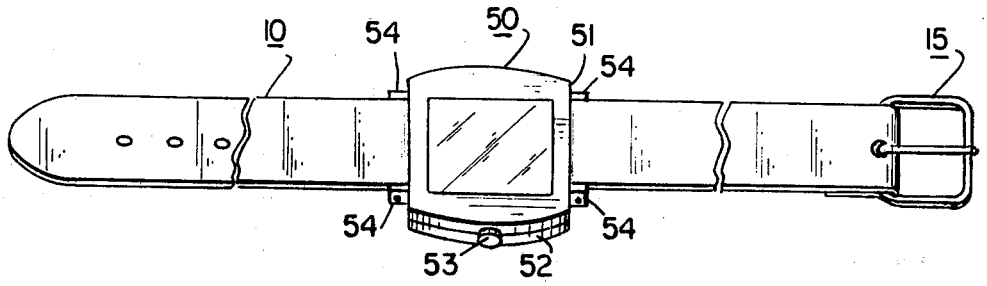

The embodiment of FIG. 1 shows the device configured to resemble a wristwatch. The means for affixing the device to the user's arm include strap 10 with buckle assembly 15, attached to case 50. Lower housing 52 furnishes lugs 54 which receive pins (not shown) for holding strap assembly 10 to the device. Upper housing 51 snaps off for assembly and battery replacement, and crown 53 is used to activate main on-off switch 110 through stem 55, shown in FIG. 2. In use for a right-handed bowler, crown 53 is on the distal side of case 50, that is, toward the bowler's hand. The assembly can be reversed for left-handed bowlers, or alternatively, the left-handed bowler can wear the device depicted in FIG. 1 on the volar surace, or underside, of the arm.

The embodiment of FIG. 1 can readily be adapted to other modes of locating the device on the bowler's arm. Thus, case 50 could be attached to a hook-and-loop nylon material, such as Velcro. Case 50 can also be attached with a strap or Velcro patch to a bowler's glove, or the glove can be suitably modified to include fastening means. When the device is attached to a glove, it can readily be rotated 180° to achieve the requisite orientation for either right- or left-handed bowlers.

Figure 2:
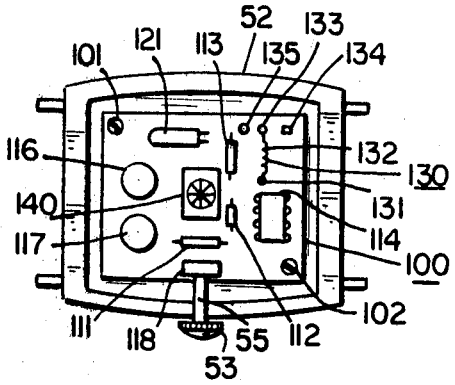
FIG. 2 is a view of the device of FIG. 1 with the cover removed to show the location of parts.

FIG. 2 illustrates the layout of components within case 50 as they would appear when upper housing 51 is removed from lower housing 52. All of the components are mounted on circuit board 100 which is secured to lower housing 52 by screw fasteners 101 and 102. Board 100 holds capacitors 111 and 112, resistor 113, timer integrated circuit 114, two 1.5-volt button cells 116 and 117, on-off switch 118, sensor means 121 and 130, and piezoelectric acoustic element 140. Other than for the orientation of switches 121 and 130, the parts layout is elective. It is, however, desirable that stem 55 and crown 53 be placed as on a watch, so that the correct orientation of board 100 can readily be perceived.

The location of switches 121 and 130 is important in the functioning of the embodiment shown in FIG. 2. Switch 130 comprises coil 132 attached to board 100 at its end 131. Coil 132 is free to move along the plane of board 100 from stop 134 to contact 135. On the backswing of the user's arm, the end of coil 132 moves to contact 135, thereby completing an electrical circuit. The acceleration of the arm through the bottom of the swing and upwardly before and after release of the ball urges the end of coil 132 against contact 135, thereby maintaining the circuit in a closed condition. At substantially the top of the swing, mercury switch 121 closes.

Figure 3:
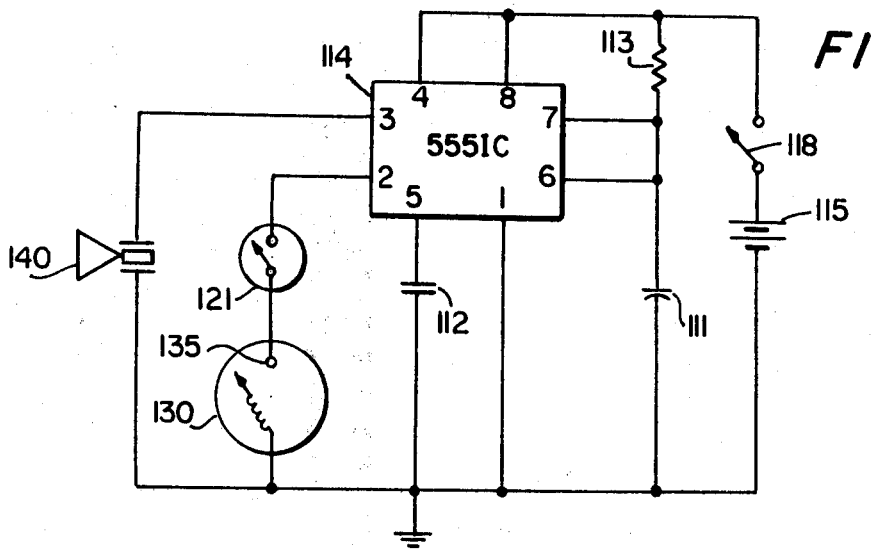
FIG. 3 is a circuit diagram of the device in FIG. 2.

The electrical action of the circuit can be more easily appreciated by reference to FIG. 3. Switch 118 is the optional on-off switch which can be used to disable the device. Battery 115 is comprised by the two button cells, and is the power source which operates the device. In the preferred embodiment shown, timer IC 114, a 555 DIP, is used as a one-shot to control the length of the tone emitted by piezoelectric acoustic element 140. Such elements are avaiable for example as Piezo-Alarms from Marata Georgia or Gulton Industries.

In the embodiment shown, when sensors 121 and 130 are both closed, a tone is produced for about one second. The tone duration is controlled by resistor 111, suitably 200 kilohms, and capacitor 113, suitably 5 microfarads. Capacitor 112, suitably 0.1 microfarads, serves to cause the 555 timer chip to function as a one-shot. When the circuit is broken by opening either or both of sensors 121 and 130, timer 114 is reset for the next use.

The function of sensor 130 is to close upon the backswing of the arm and remain closed during the downward swing, ball release, and upward follow-through. The function of sensor 121 is to close when the bowler's arm reaches a substantially vertical position. While a mercury switch is shown, another suitable gravity-activated switch could be used to close the circuit completely and thereby trigger timer 114. In one embodiment, a fluid-damped mercury switch is utilized.

It will be understood that the term "substantially vertical" used to describe the attitude of the arm, and hence of sensor 121, has particular reference to a plane perpendicular to the travel of the arm and bowling ball. It has been found that good results can be obtained when the arm is within 5 degrees of arc or less of the vertical in this plane and that the vertical orientation of the bowler's arm in the other vertical plane orthogonal to this is not as important.

In lieu of a coil spring for switch 130, other suitable acceleration-activated switches can be used. In one preferred embodiment, the coil is replaced with a stainless steel wire having a weight at the free end which is free to touch contact 135. The properties of the switch are readily controlled by sizing the wire for appropriate stiffness relative to the weight.

FIG. 4 is a simplified illustration of another embodiment of the invention with a different sensor system. Lower housing 152 corresponds to lower housing 52 in FIGS. 1 and 2. Since there is no crown-and-stem master on-off switch in this embodiment, reference figure 153 is used to indicate the distal side of lower housing 152.

For simplicity of illustration, board 200 in housing 152 is shown containing sensors 201 and 202, with the remaining components omitted. Sensor 201 is shown as a single-ended mercury switch, and sensor 202 is also a single-ended mercury switch attached to board 200 by lead wires 203. Sensor 202 is additionally viscous-damped by having the tube, which contains the mercury, filled with oil.

In order to obtain the correct operation as a bowler's training aid, sensor 202 is connected at an angle to the plane of board 200, as shown in FIG. 5. The angle defined by the body of sensor 202 and the plane of the board is less than 45°. In certain preferred embodiments, the angle defined is about 33° to about 40° from the plane of board 200. Sensor 201 is a mercury switch similar to sensor 121 in the foregoing embodiment.

Different circuitry is required to utilize the sensors in this embodiment, and this is illustrated in FIG. 6. In addition to sensors 201 and 202, the circuit comprises battery power source 212, annunciator 213, logic circuits 214, 215, and 216, timers 217 and 218, and pull-down resistors 210 and 211. Timer 217 functions to provide a time delay in conjunction with the logic circuit and timer 218 functions to regulate the duration of the annunciator action. The annunciator in any embodiment can be aural, visual, such as a light-emitting diode (LED), or both aural and visual.

Switch 219 is used as a master on-off switch to reduce current drain when the device is not in use. Switch 219 is closed by a pin (not shown) in the bottom of lower housing 152, so that the circuit is enabled only when worn on the wrist of the user. There is accordingly no requirement for a manually activated master switch, although such could be used in series with switch 219, if desired.

The circuit of FIG. 6 acts by utilizing sensor 202 to complete a circuit to start timer 217 when sensor 201 is also closed. The logic elements shown are three triple-input NAND circuits such as are available in the CD 4023. NAND element 214 acts to start timer 217; NAND element 215 acts as an inverter; and NAND element 216 acts to activate timer 218 when the proper logic condition is reached by closure and reopening of sensors 201 and 202, depending upon the attitudes of these latter.

Timers 217 and 218 in the embodiment shown can be set for times of two to five seconds and 0.3 to three seconds, respectively. In certain preferred embodiments, timer 217 is a one-shot three-second timer and timer 218 is a one-shot one-second timer. Each of 217 and 218 can be 555 IC's with appropriate R-C values to obtain the desired times, or a single 556 integrated circuit can be used.

The operation of the FIG. 6 circuit can best be understood by reference to the following logic, or "truth", table, wherein the 201 column shows the status of sensor 201; the 202 column shows the status of sensor 202; the 214 column shows the output status of NAND 214; the 217 column shows the output status of 217; the 215 column shows the output status of inverter 215; the 216 column shows the output status of NAND 216, and the 218 column shows the output status of timer 218—and hence the status of annunciator 213:

TRUTH TABLE

| CONDITION | 201 | 202 | 214 | 217 | 215 | 216 | 218 |
|---|---|---|---|---|---|---|---|
| 1 | 1 | 0 | 1 | 0 | 1 | 1 | 0 |
| 2 | 0 | 1 | 1 | 0 | 0 | 1 | 0 |
| 3 | 1 | 1 | 0 | 1 | 0 | 1 | 0 |
| 4 | 0 | 1 | 1 | 1 | 0 | 1 | 0 |
| 5 | 0 | 0 | 1 | 1 | 1 | 1 | 0 |
| 6 | 1 | 0 | 1 | 1 | 1 | 0 | 1 |
| 7A | 0 | 0 | 1 | 1 | 1 | 1 | 0 |
| 7B | 0 | 1 | 1 | 0 | 0 | 1 | 0 |
| 7C | 1 | 0 | 1 | 0 | 1 | 1 | 0 |

It will be understood that the status of timer 218 and hence annunciator 213 will change back to logic zero when timer 218 times out. Annunciator 213 will not thereafter be activated until NAND 216 returns to logic zero.

It will be apparent from the foregoing that variations can be made in the foregoing without departing from the scope of the invention as claimed. Various sensor configurations can be utilized. Custom integrated circuits can contain all the logic and/or timing elements. The sensors and logic elements can be varied for other uses. If desired, the annunciator could, for instance, sound on the backswing and sound a different or longer tone upon attaining the correct follow-through. The device could be incorporated into a glove or into a jacket or other apparel which would fix the orientation.

In another embodiment, a third sensor can be utilized to sense the acceleration and/or attitude of the user's arm at the end of the backswing. This additional sensor can then be used to provide a signal through the annunciator, for example, a differently pitched tone, to indicate achievement of a proper backswing. Alternatively, the third sensor could work with the other two sensors so that the device would provide a signal only when all of the sensors detected the correct motion, or the third sensor could be switchable in and out of the circuit to provide the two different modes selectively.

It can also be appreciated that the devices of this invention are readily used in a method for teaching proper bowling technique. The device is affixed to the arm of the bowler, and the bowler is led to act so as to cause the annunciator to sound. Thus, the device can be worn continuously, it can be worn initially during a "warm-up" or conditioning phase, or it can be used only periodically once the proper technique has been learned to reinforce the technique or bring the swing back up to a technically better state.

What is claimed is:

1. A device to assist in improvement of bowling skills which comprises a case having means for attaching the device to a user's arm in a predetermined orientation; a first acceleration-sensing means capable of making or breaking an electrical circuit; a second sensing means capable of making or breaking an electrical circuit; an electrical power source; and annunciator, the first sensing means making an electrical circuit when a first preselected condition is sensed and the second sensing means making an electrical circuit when a predetermined attitude is sensed, the said second sensing means being electrically connected to said first sensing means wherein the resultant electrical circuit being made by the second sensing means only after making of the circuit by the first sensing means occurs and the electrical circuit made by the second sensing means activating the annunciator.

2. A device according to claim 1 wherein the first sensing means makes the circuit when the user's arm is moved rearwardly from a vertical position and the second sensing means makes the circuit when the user's arm is substantially vertical.

3. A device according to claim 1 which additionally includes a delay means by which making of the circuit by the first sensing means will continue to maintain a closed circuit for a preselected period of time.

4. A device according to claim 3 wherein the period of time is from about one to about ten seconds.

5. A device according to claim 3 wherein the period of time is from about one to about three seconds.

6. A device according to claim 1 additionally including a timing means to activate the signal means for a preselected time of from about 0.3 to about three seconds.

7. A device according to claim 1 wherein the annunciator means provides an audible signal.

8. A device according to claim 7 wherein the annunciator provides an audible signal.

9. A device according to claim 1 wherein the attaching means comprises a strap and a platform adapted to be affixed to the anterior or volar surface of the user's wrist; the first sensing means comprising an inertia switch mounted on the platform; the second sensing means comprising a mercury switch mounted on the platform; the electrical power source being a battery; and the annunciator being a piezoelectric sounder.

10. A device according to claim 9 additionally comprising an on-off switch for respectively enabling and disabling the entire circuit.

11. A method for improving the bowling skills of an individual bowler, which method comprises affixing the device of claim 1 to the arm of a bowler and having the bowler throw balls with correct follow-through to activate the annunciator.

12. A device according to claim 1 wherein the annunciator means provides a visual signal.

* * * * *

UNITED STATES PATENT AND TRADEMARK OFFICE

CERTIFICATE OF CORRECTION

PATENT NO. : 4,330,123

DATED : May 18, 1982

INVENTOR(S) : BEN KLEINERMAN

It is certified that error appears in the above-identified patent and that said Letters Patent are hereby corrected as shown below:

Column 1, line 25, change "transistory" to --transitory--.

Column 2, line 31, change "than" to --then--; line 65, correct spelling of "surface".

Column 3, line 41, correct spelling of "available"; line 42, change "Marata" to --Murata--.

Column 5, lines 1-2, correct spelling of "understood".

Column 6, line 17, after "means" insert --occurs--; line 18, delete "occurs".

Signed and Sealed this

*Twelfth* Day of *October 1982*

[SEAL]

*Attest:*

GERALD J. MOSSINGHOFF

*Attesting Officer*

*Commissioner of Patents and Trademarks*